US011006205B1

(12) United States Patent
Thoen

(10) Patent No.: US 11,006,205 B1
(45) Date of Patent: May 11, 2021

(54) ACOUSTIC DEVICE

(71) Applicant: NXP B.V., Eindhoven (NL)

(72) Inventor: Steven Mark Thoen, Blanden (BE)

(73) Assignee: NXP B.V., Eindhoven (NL)

( * ) Notice: Subject to any disclaimer, the term of this patent is extended or adjusted under 35 U.S.C. 154(b) by 0 days.

(21) Appl. No.: 16/668,246

(22) Filed: Oct. 30, 2019

(51) Int. Cl.

| | |
|---|---|
| ***H04R 1/10*** | (2006.01) |
| ***H04R 5/033*** | (2006.01) |
| ***G10L 21/0232*** | (2013.01) |
| ***G10L 25/51*** | (2013.01) |
| ***H04S 1/00*** | (2006.01) |

(52) U.S. Cl.
CPC ..... *H04R 1/1083* (2013.01); *G10L 21/0232* (2013.01); *G10L 25/51* (2013.01); *H04R 1/1016* (2013.01); *H04R 5/033* (2013.01); *H04S 1/007* (2013.01)

(58) Field of Classification Search
CPC .. H04R 5/033; H04R 1/1083; H04R 2410/05; G10K 2210/108
USPC ..... 381/309, 74, 71.11, 71.12
See application file for complete search history.

(56) References Cited

U.S. PATENT DOCUMENTS

| | | | | |
|---|---|---|---|---|
| 8,798,278 | B2 | 8/2014 | Isabelle et al. | |
| 2016/0241947 | A1* | 8/2016 | Degraye | G06F 3/0488 |
| 2018/0176696 | A1 | 6/2018 | Voigt Pedersen | |
| 2018/0279059 | A1* | 9/2018 | Swanson | H04R 25/558 |
| 2020/0005770 | A1* | 1/2020 | Lunner | G10L 15/16 |

FOREIGN PATENT DOCUMENTS

| | | | |
|---|---|---|---|
| CN | 105554610 | A | 5/2016 |
| CN | 105554610 | B | 1/2019 |
| WO | WO-2019/183225 | A1 | 9/2019 |

OTHER PUBLICATIONS

Hunn, Nick; "The Market for Smart Wearable Technology—A Consumer Centric Approach"; retrieved from the Internet http://www.nickhunn.com/wp-content/uploads/downloads/2015/07/The-Market-for-Smart-Wearables-Feb-2015-3rd-Edition-rev2.pdf; 63 pages (Feb. 2015).

* cited by examiner

*Primary Examiner* — Alexander Krzystan

(57) ABSTRACT

One example discloses an acoustic device, including: a first input configured to receive a first ambient input signal from a first acoustic transducer; a second input configured to receive a second ambient input signal from a second acoustic transducer; a first output configured to transmit a first ambient output signal; a second output configured to transmit a second ambient output signal; an ambient signal characterization circuit configured to identify an undesired ambient signal within the first and/or second ambient input signals; and an ambient signal control circuit configured to control how the acoustic device generates the first and second ambient output signals from the first and second ambient input signals based on the undesired ambient signal.

23 Claims, 3 Drawing Sheets

ACOUSTIC DEVICE

The present specification relates to systems, methods, apparatuses, devices, articles of manufacture and instructions for an acoustic device.

SUMMARY

According to an example embodiment, an acoustic device, comprising: a first input configured to receive a first ambient input signal from a first acoustic transducer; a second input configured to receive a second ambient input signal from a second acoustic transducer; a first output configured to transmit a first ambient output signal; a second output configured to transmit a second ambient output signal; an ambient signal characterization circuit configured to identify an undesired ambient signal within the first and/or second ambient input signals; and an ambient signal control circuit configured to control how the acoustic device generates the first and second ambient output signals from the first and second ambient input signals based on the undesired ambient signal.

In another example embodiment, the first input and the first output correspond to a left audio channel; and the second input and the second output correspond to a right audio channel.

In another example embodiment, the ambient signal control circuit configures the acoustic device to generate the first and second ambient output signals from the first and second ambient input signals by removing the undesired ambient signal.

In another example embodiment, the ambient signal control circuit outputs an ambient input selection signal; (e.g. R or L binary selection); the ambient input selection signal is set to a first state when the first ambient input signal includes more of the undesired ambient signal than the second ambient input signal; and the first state configures the acoustic device to generate the first and second ambient output signals from only the second ambient input signal.

In another example embodiment, the ambient input selection signal is set to a second state when the second ambient input signal includes more of the undesired ambient signal than the first ambient input signal; and the second state configures the acoustic device to generate the first and second ambient output signals from only the first ambient input signal.

In another example embodiment, the ambient input selection signal is set to a third state when both the first and second ambient input signals include the undesired ambient signal; and the third state configures the acoustic device to block both the first and second ambient output signals In another example embodiment, the ambient signal control circuit outputs an ambient input modulation signal (e.g. R or L attenuation/volume); and the ambient input modulation signal attenuates the first ambient input signal more than the second ambient input signal if the first ambient input signal includes more of the undesired ambient signal than the second ambient input signal.

In another example embodiment, the ambient input modulation signal attenuates the second ambient input signal more than the first ambient input signal if the second ambient input signal includes more of the undesired ambient signal than the first ambient input signal.

In another example embodiment, the ambient input modulation signal attenuates both the first and second ambient input signals if both the first and second ambient input signals include the undesired ambient signal.

In another example embodiment, the undesired ambient signal is wind noise.

In another example embodiment, the undesired ambient signal is vehicular noise.

In another example embodiment, the ambient signal characterization circuit is configured to identify the undesired ambient signal based on the undesired signal's specific frequency content and/or time domain properties.

In another example embodiment, further comprising a set of mixers coupled to receive the first and second ambient output signals; wherein the set of mixers are coupled to receive a set of audio playback signals from an audio receiver; and wherein the set of mixers are configured to mix (e.g. convolve) the first and second ambient output signals with the set of audio playback signals.

In another example embodiment, the set of mixers include a left audio mixer configured to generate a left mixed audio signal from the first ambient output signal and a left audio playback signal received from an audio receiver; and the set of mixers include a right audio mixer configured to generate a right mixed audio signal from the second ambient output signal and a right audio playback signal from the audio receiver.

In another example embodiment, further comprising a set of acoustic speakers coupled to receive and output the left and right mixed audio signals.

In another example embodiment, further comprising the first and second acoustic transducers.

In another example embodiment, the second acoustic transducer embedded in a second acoustic device; the second input is configured to receive the second ambient input signal over a wireless link from the second acoustic device; and the second output is configured to transmit the first ambient input signal over a wireless link to the second acoustic device that, in response to either an ambient input selection signal and/or an ambient input modulation signal, becomes the second ambient output signal.

In another example embodiment, the acoustic device is a first earbud and the second acoustic device is a second earbud.

In another example embodiment, the wireless link is a near-field communications link.

In another example embodiment, a second ambient signal characterization circuit is embedded in the second wireless device; and the ambient signal characterization circuit and the second ambient signal characterization circuit communicate over the wireless link and together are configured to identify the undesired ambient signal within the first and/or second ambient input signals.

In another example embodiment, a second ambient signal control circuit is embedded in the second wireless device; and the ambient signal control circuit and the second ambient signal control circuit communicate over the wireless link and together configure how the acoustic device and the second acoustic device generate the first and second ambient output signals from the first and second ambient input signals based on the undesired ambient signal.

In another example embodiment, the acoustic device includes a left audio mixer coupled to receive the first ambient output signal; and the second acoustic device includes a right audio mixer coupled to receive the second ambient output signal.

In another example embodiment, the left audio mixer is configured to generate a left mixed audio signal from the first ambient output signal and a left audio playback signal received from an audio receiver; and the right audio mixer is configured to generate a right mixed audio signal from the second ambient output signal and a right audio playback signal received over the wireless link from the audio receiver.

The above discussion is not intended to represent every example embodiment or every implementation within the scope of the current or future Claim sets. The Figures and Detailed Description that follow also exemplify various example embodiments.

Various example embodiments may be more completely understood in consideration of the following Detailed Description in connection with the accompanying Drawings.

Figure 1:
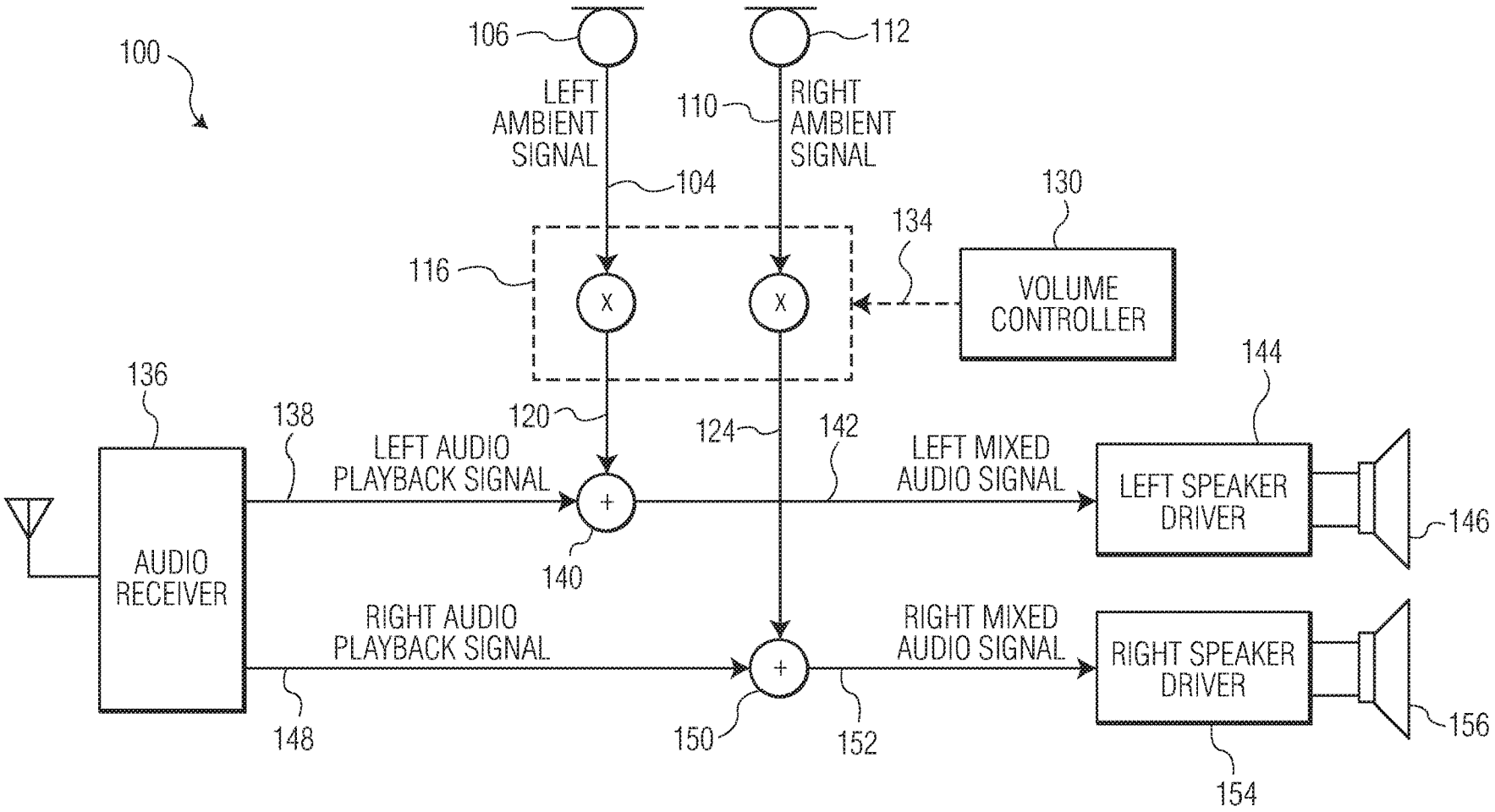
FIG. 1 is an example headset device including hear-through circuitry.

While the disclosure is amenable to various modifications and alternative forms, specifics thereof have been shown by way of example in the drawings and will be described in detail. It should be understood, however, that other embodiments, beyond the particular embodiments described, are possible as well. All modifications, equivalents, and alternative embodiments falling within the spirit and scope of the appended claims are covered as well.

DETAILED DESCRIPTION

Hear-through functionality in headsets and hearables (e.g. earbuds) is herein defined as a technology that mixes ambient environmental sounds, picked up by an external microphone, into mono or stereo audio signals that are played back to a user in order to increase that user's situational awareness within an ambient environment.

Hear-through functionality is often beneficial in outdoor environments so that users can remain aware of their surroundings, for conversation, safety (e.g. to hear traffic), and so on.

FIG. 1 is an example headset device 100 including hear-through circuitry. In the example device 100, a first ambient input signal 104 (e.g. left ambient input signal) is received from a first acoustic transducer 106 (e.g. left headset microphone), and a second ambient input signal 110 (e.g. right ambient input signal) is received from a second acoustic transducer 112.

An ambient signal attenuation-matrix 116 (e.g. volume attenuation) generates a first ambient output signal 120 from the first ambient input signal 104 (e.g. left ambient input signal from the left headset microphone), and generates a second ambient output signal 124 from the second ambient input signal 110 (e.g. right ambient input signal from the right headset microphone) in response to an ambient input modulation signal 134 from a volume controller 130.

An audio receiver 136 receives communications using either an antenna (e.g. as a Bluetooth signal) or a hard-wired cord.

The audio receiver 136 in response outputs a left audio playback signal 138 that is sent to a left audio mixer 140. The left audio mixer 140 mixes the left audio playback signal 138 with the first ambient output signal 120 and outputs a left mixed audio signal 142. The left mixed audio signal 142 is sent to a left speaker driver 144 and output on a left speaker 146.

The audio receiver 136 also outputs a right audio playback signal 148 that is sent to a right audio mixer 150. The right audio mixer 150 mixes the right audio playback signal 148 with the second ambient output signal 124 and outputs a right mixed audio signal 152. The right mixed audio signal 152 is sent to a right speaker driver 154 and output on a right speaker 156.

In some example of the example headset device 100, or a similar hearable device (e.g. right and left earbuds), a user has to either manually switch the hear-through functionality (i.e. the ambient signal attenuation-matrix 116) on or off, or manually adjust a hear-through volume level (i.e. the ambient input modulation signal 134 from the volume controller 130).

However, certain undesired ambient sounds received by the first and second acoustic transducers 106, 112 may provide little if any situational awareness and thus be very annoying or distracting to a user if mechanically mixed in with a user's normal audio playback signals. Such undesirable ambient sounds (e.g. wind, busy highway noise, etc.) may also substantially or completely saturate (e.g. mask out, block, etc.) the desired right and left audio playback signals 138, 148.

Now discussed are example embodiments of acoustic devices that automatically control which and how various ambient environmental sounds are mixed into a device's normal audio playback signals. In some example embodiments, these acoustic devices can enable a wind noise reduction (WNR) circuit in a headset and/or hearable. Such acoustic devices would automatically detect undesirable ambient noise signals (e.g. wind noise) and vary how the ambient sounds received by various acoustic transducers are mixed into normal and desired audio playback signals so as to mitigate an effect of these undesirable ambient noise signals on the normal audio playback to a user.

Figure 2:
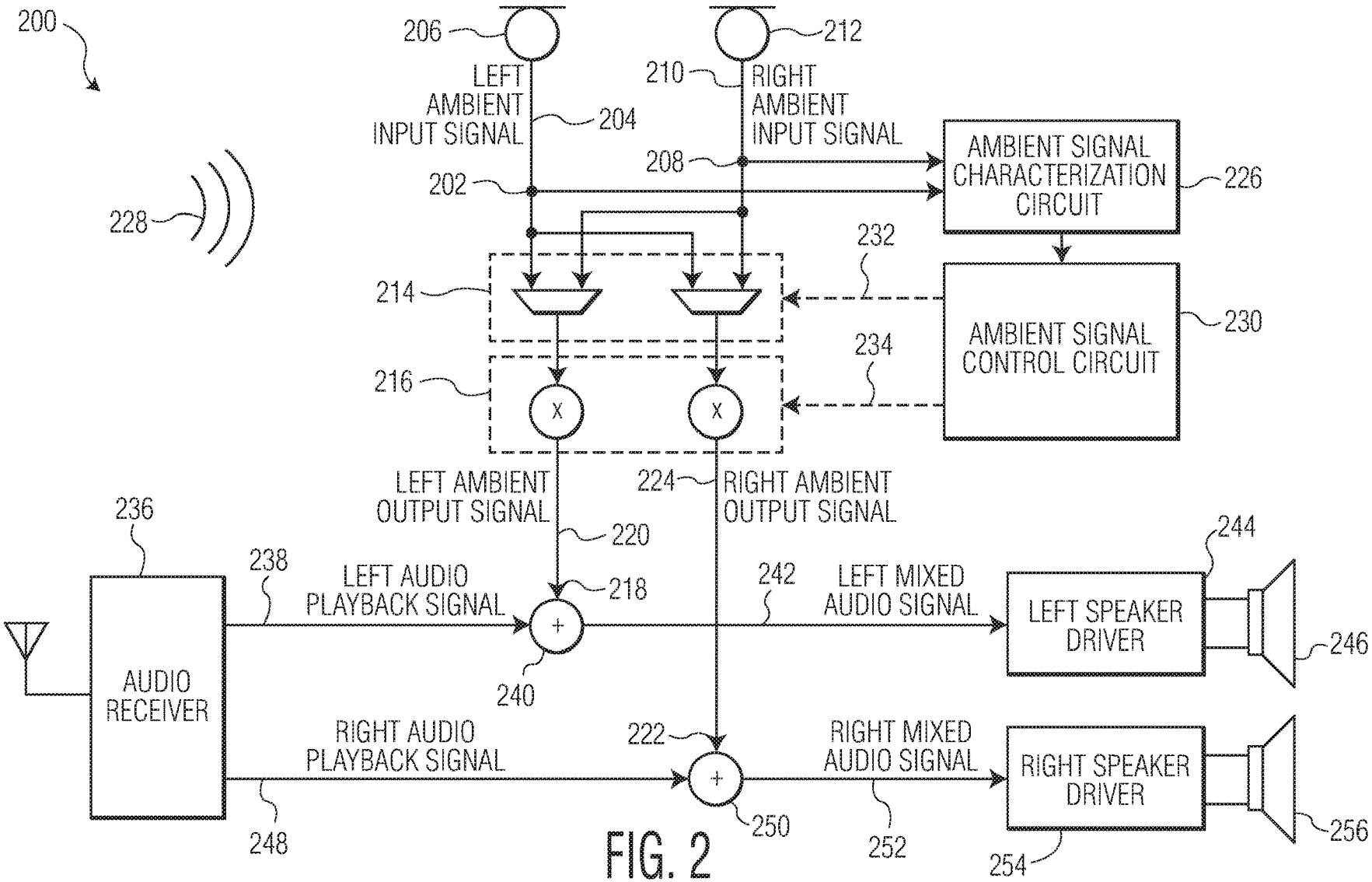
FIG. 2 is a first example acoustic device.

FIG. 2 is a first example 200 acoustic device including different hear-through circuitry. In some example embodiments, the first example 200 acoustic device is embedded in a headset.

In the example device 200, a first ambient input signal 204 (e.g. left ambient input signal) is received on a first input 202 from a first acoustic transducer 206 (e.g. left headset microphone), and a second ambient input signal 210 (e.g. right ambient input signal) is received on a second input 208 from a second acoustic transducer 212.

An ambient signal switch-matrix 214 selects between the first ambient input signal 204 (e.g. left ambient input signal) and the second ambient input signal 210 (e.g. right ambient input signal) in response to an ambient input selection signal 232 from an ambient signal control circuit 230. This selected ambient input signal is then passed on to an ambient signal attenuation-matrix 216.

The ambient signal attenuation-matrix 216 (e.g. volume attenuation) generates a first ambient output signal 220 and a second ambient output signal 224 from the selected ambient input signal in response to an ambient input modulation signal 234 from the ambient signal control circuit 230.

An audio receiver 236 receives communications using either an antenna (e.g. as a Bluetooth signal) or a hard-wired cord.

The audio receiver 236 in response outputs a left audio playback signal 238 that is sent to a left audio mixer 240. The left audio mixer 240 mixes the left audio playback signal 238 with the first ambient output signal 220 and outputs a left mixed audio signal 242. The left mixed audio signal 242 is sent to a left speaker driver 244 and output on a left speaker 246.

The audio receiver 236 also outputs a right audio playback signal 248 that is sent to a right audio mixer 250. The right audio mixer 250 mixes the right audio playback signal 248 with the second ambient output signal 224 and outputs a right mixed audio signal 252. The right mixed audio signal 252 is sent to a right speaker driver 254 and output on a right speaker 256.

An ambient signal characterization circuit 226 (e.g. confidence level circuit) identifies an undesired ambient signal 228 within the first and/or second ambient input signals 204, 210. The undesired ambient signal 228 can be a variety of pre-selected noise types, including wind, vehicular, electronic, and etc. noise.

The ambient signal characterization circuit 226 uses a variety of voice and audio techniques known to those skilled in the art to identify the undesired ambient signal 228 from either or both of the ambient input signals 204, 210. The presence of undesired signals can also be directly estimated based on the undesired signal's specific frequency content and/or time domain properties.

Based on a physical direction that the undesired ambient signal 228 is being received from, as determined by the ambient signal characterization circuit 226, the ambient signal control circuit 230 configures how the acoustic device 200 generates the first and second ambient output signals 220, 224 from the first and second ambient input signals 204, 210 based on the undesired ambient signal 228.

In some example embodiments, the ambient signal control circuit 230 sets the ambient input selection signal 232 and the ambient input modulation signal 234 so as to remove the undesired ambient signal.

In a first example, if the first ambient input signal 204 includes more of the undesired ambient signal 228 than the second ambient input signal 210 (e.g. wind noise is coming from the left), then the ambient signal control circuit 230 sets the ambient input selection signal 232 so the first and second ambient output signals 220, 224 are only generated from the second (e.g. right side) ambient input signal 210. Alternatively or in addition to, the ambient signal control circuit 230 can set the ambient input modulation signal 234 to substantially attenuate one or both of the ambient input signals 204, 210.

Note that while FIG. 2 shows the ambient signal switch-matrix 214 receiving the ambient input signals 204, 210 before the ambient signal attenuation-matrix 216 does, in alternate example embodiments their positions can be reversed so that the ambient signal attenuation-matrix 216 receives the ambient input signals 204, 210 first.

In a second example, if the second ambient input signal 210 includes more of the undesired ambient signal 228 than the first ambient input signal 204 (e.g. wind noise is coming from the right), then the ambient signal control circuit 230 sets the ambient input selection signal 232 so the first and second ambient output signals 220, 224 are only generated from the first (e.g. left side) ambient input signal 204. As mentioned above, the ambient signal control circuit 230 can also set the ambient input modulation signal 234 to substantially attenuate one or both of the ambient input signals 204, 210.

If both the first and second ambient input signals 204, 210 include the undesired ambient signal, then the ambient signal control circuit 230 can use either or both the ambient input selection signal 232 (e.g. input selection) and the ambient input modulation signal 234 (e.g. volume control) to either block or substantially attenuate the first and second ambient output signals 220, 224.

Thus by using, for example, the other side's microphone when one (e.g. right or left) microphone is saturated by wind noise while the other side is unaffected by wind can avoid the effect of the wind noise altogether while retaining the situational awareness of the hear-through functionality. Depending on the wind direction, there is a very high likelihood that only one side of the acoustic device 200 (e.g. headset) is actually exposed to the wind since a wearer's skull acts as a natural wind barrier. Thus this dynamic microphone selection technique works very well.

More elaborate implementations of the acoustic device 200 (e.g. headset) can build in hysteresis in the ambient signal control circuit 230 control loop to avoid transitory switching and/or attenuation, enabling smooth ramp up and ramp down profiles.

In some example embodiments such as shown in FIG. 2, the ambient signal switch-matrix 214 and the ambient signal attenuation-matrix 216 do not sit in the audio playback signals 238, 248 path and hence does not add to an overall delay of the ambient output signals 220, 224 thereby minimizing latency and maintaining a high level of situational awareness.

Figure 3:
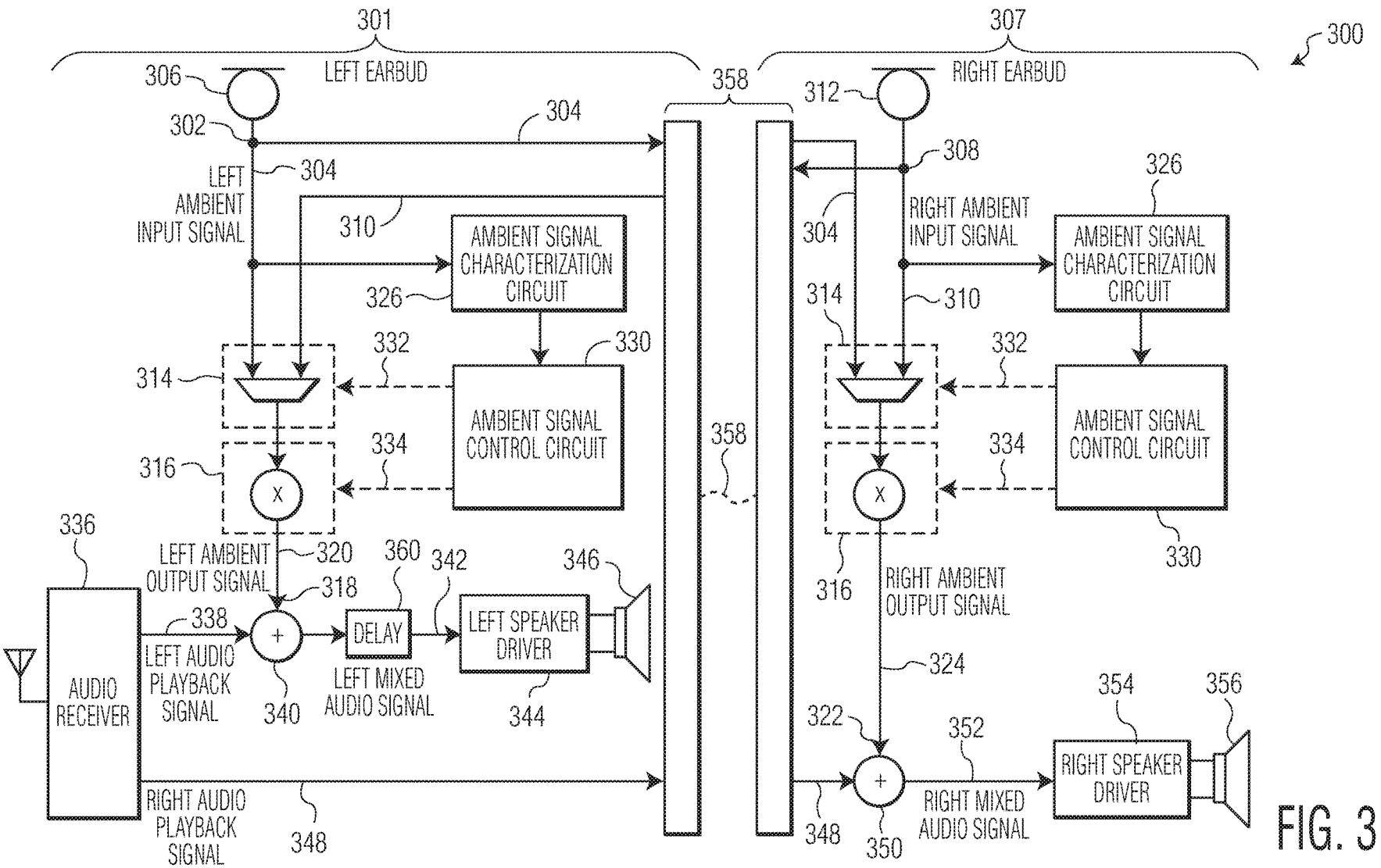
FIG. 3 is a second example distributed between a first acoustic device and a second acoustic device.

FIG. 3 is a second example 300 distributed between a first acoustic device 301 and a second acoustic device 307. In some example embodiments, the first and second acoustic devices 301, 307 are two hearables (e.g. right and left earbuds).

In the example first acoustic device 301, a first ambient input signal 304 (e.g. left ambient input signal) is received on a first input 302 from a first acoustic transducer 306 (e.g. left headset microphone). In the second acoustic device 307, a second ambient input signal 310 (e.g. right ambient input signal) is received on a second input 308 from a second acoustic transducer 312. These signals 304, 310, along with other signals discussed below, are shared between the two devices 301, 307 (e.g. two earbuds) using a wireless communications link 358 (e.g. near-field signaling).

In some example embodiments, the wireless link 358 is uses near-field magnetic induction (NFMI) to minimize an overall latency of signal and data exchange over the wireless link 358. NFMI, and its cousin near field electromagnetic induction (NFEMI), are communications protocols that receive non-propagating quasi-static magnetic near-field signals through free-space, and non-propagating quasi-static electric near-field signal from conductive structures.

Near-field protocols, due to their low latency, can quickly and robustly exchange signals such as audio between the acoustic devices 310, 307 so as to best maintain hear-through situational awareness. For example the delay of near-field signals over the wireless link 358 can be as low as 3 ms when using a G.722 codec. Near-field protocols have a substantial lower latency than other protocols (e.g. TWS having delays of >100 ms) when transport audio between hearables. Near-field protocols also support multiple signal level and data streams between both devices 301, 307 (e.g. between left and right earbuds).

A distributed ambient signal switch-matrix 314 selects between the first ambient input signal 304 (e.g. left ambient input signal) and the second ambient input signal 310 (e.g. right ambient input signal) in response to a distributed ambient input selection signal 332 from a distributed ambient signal control circuit 330. This selected ambient input signal is then passed on to a distributed ambient signal attenuation-matrix 316.

Distributed is herein defined to include circuits that exchanges signal levels and data over the wireless communications link 358 so as to substantially synchronize their operation. FIG. 3 labels signals with a same reference number as an indication that such signals are shared over the wireless communications link 358 between devices 301, 307.

The ambient signal attenuation-matrix 316 (e.g. volume attenuation) generates a first ambient output signal 320 and a second ambient output signal 324 from the selected ambient input signal in response to an ambient input modulation signal 334 from the ambient signal control circuit 330.

An audio receiver 336 receives communications using either an antenna (e.g. as a Bluetooth signal) or a hard-wired cord.

The audio receiver 336 in response outputs a left audio playback signal 338 that is sent to a left audio mixer 340. The left audio mixer 340 mixes the left audio playback signal 338 with the first ambient output signal 320 and outputs a left mixed audio signal 342. The left mixed audio signal 342 is sent to a left speaker driver 344 and output on a left speaker 346.

The audio receiver 336 also outputs a right audio playback signal 348 that is sent to a right audio mixer 350. The right audio mixer 350 mixes the right audio playback signal 348 with the second ambient output signal 324 and outputs a right mixed audio signal 352. The right mixed audio signal 352 is sent to a right speaker driver 354 and output on a right speaker 356.

A delay 360 is added in the left mixed audio signal 342 to substantially match a delay of transmitting the right audio playback signal 348 over the wireless communications link 358.

A distributed ambient signal characterization circuit 326 (e.g. confidence level circuit) identifies an undesired ambient signal (not shown) within the first and/or second ambient input signals 304, 310. As introduced above, the undesired ambient signal can be a variety of pre-selected noise types, including wind, vehicular, electronic, and etc. noise.

The distributed ambient signal characterization circuit 326 operates substantially similar to the ambient signal characterization circuit 226, and the distributed ambient signal control circuit 330 operates substantially similar to the ambient signal control circuit 230, as discussed with respect to FIG. 2.

In some example embodiments, the left and right ambient output signals 320, 324 are delayed to substantially match the delay of the wireless communications link 358. However, to maintain situational awareness, other example embodiments do not include such a delay, in part because a phase relation between the left and right ambient output signals 320, 324 is not as critical as a phase relation between the left and right audio playback signals 338, 348.

In some example embodiments when the undesired ambient signal is coming from the left, by playing back the right ambient output signal 324 slightly earlier on the right earbud 307 than the left ambient output signal 320 on the left earbud 301, the soundscape will remain more or less intact with a earbud user having an impression that the needed situational awareness information comes from the right hand side as intended.

Various instructions and/or operational steps discussed in the above Figures can be executed in any order, unless a specific order is explicitly stated. Also, those skilled in the art will recognize that while some example sets of instructions/steps have been discussed, the material in this specification can be combined in a variety of ways to yield other examples as well, and are to be understood within a context provided by this detailed description.

In some example embodiments these instructions/steps are implemented as functional and software instructions. In other embodiments, the instructions can be implemented either using logic gates, application specific chips, firmware, as well as other hardware forms.

When the instructions are embodied as a set of executable instructions in a non-transitory computer-readable or computer-usable media which are effected on a computer or machine programmed with and controlled by said executable instructions. Said instructions are loaded for execution on a processor (such as one or more CPUs). Said processor includes microprocessors, microcontrollers, processor modules or subsystems (including one or more microprocessors or microcontrollers), or other control or computing devices. A processor can refer to a single component or to plural components. Said computer-readable or computer-usable storage medium or media is (are) considered to be part of an article (or article of manufacture). An article or article of manufacture can refer to any manufactured single component or multiple components. The non-transitory machine or computer-usable media or mediums as defined herein excludes signals, but such media or mediums may be capable of receiving and processing information from signals and/or other transitory mediums.

It will be readily understood that the components of the embodiments as generally described herein and illustrated in the appended figures could be arranged and designed in a wide variety of different configurations. Thus, the detailed description of various embodiments, as represented in the figures, is not intended to limit the scope of the present disclosure, but is merely representative of various embodiments. While the various aspects of the embodiments are presented in drawings, the drawings are not necessarily drawn to scale unless specifically indicated.

The present invention may be embodied in other specific forms without departing from its spirit or essential characteristics. The described embodiments are to be considered in all respects only as illustrative and not restrictive. The scope of the invention is, therefore, indicated by the appended claims rather than by this detailed description. All changes which come within the meaning and range of equivalency of the claims are to be embraced within their scope.

Reference throughout this specification to features, advantages, or similar language does not imply that all of the features and advantages that may be realized with the present invention should be or are in any single embodiment of the invention. Rather, language referring to the features and advantages is understood to mean that a specific feature, advantage, or characteristic described in connection with an embodiment is included in at least one embodiment of the present invention. Thus, discussions of the features and advantages, and similar language, throughout this specification may, but do not necessarily, refer to the same embodiment.

Furthermore, the described features, advantages, and characteristics of the invention may be combined in any suitable manner in one or more embodiments. One skilled in the relevant art will recognize, in light of the description herein, that the invention can be practiced without one or more of the specific features or advantages of a particular embodiment. In other instances, additional features and advantages may be recognized in certain embodiments that may not be present in all embodiments of the invention.

Reference throughout this specification to "one embodiment," "an embodiment," or similar language means that a particular feature, structure, or characteristic described in connection with the indicated embodiment is included in at least one embodiment of the present invention. Thus, the phrases "in one embodiment," "in an embodiment," and similar language throughout this specification may, but do not necessarily, all refer to the same embodiment.

What is claimed is:

1. An acoustic device, comprising:

a first input configured to receive a first ambient input signal from a first acoustic transducer;

a second input configured to receive a second ambient input signal from a second acoustic transducer;

a first output configured to transmit a first ambient output signal;

a second output configured to transmit a second ambient output signal;

an ambient signal characterization circuit configured to identify an undesired ambient signal from within either the first or second ambient input signals; and an ambient signal control circuit configured to control how the acoustic device maps the first and second ambient output signals to either the first or second ambient input signals based on which of the ambient input signals includes more of the undesired ambient signal;

wherein the ambient signal control circuit outputs an ambient input selection signal;

wherein the ambient input selection signal is set to a first state when the first ambient input signal includes more of the undesired ambient signal than the second ambient input signal; and wherein the first state configures the acoustic device to generate the first and second ambient output signals from only the second ambient input signal.

2. The device of claim 1:

wherein the first input and the first output correspond to a left audio channel; and wherein the second input and the second output correspond to a right audio channel.

3. The device of claim 1:

wherein the ambient signal control circuit configures the acoustic device to generate the first and second ambient output signals from the first and second ambient input signals by removing the undesired ambient signal.

4. The device of claim 1:

wherein the ambient input selection signal is set to a second state when the second ambient input signal includes more of the undesired ambient signal than the first ambient input signal; and wherein the second state configures the acoustic device to generate the first and second ambient output signals from only the first ambient input signal.

5. The device of claim 4:

wherein the ambient input selection signal is set to a third state when both the first and second ambient input signals include the undesired ambient signal; and wherein the third state configures the acoustic device to block both the first and second ambient output signals.

6. The device of claim 1:

wherein the ambient signal control circuit outputs an ambient input modulation signal; and wherein the ambient input modulation signal attenuates the first ambient input signal more than the second ambient input signal if the first ambient input signal includes more of the undesired ambient signal than the second ambient input signal.

7. The device of claim 6:

wherein the ambient input modulation signal attenuates the second ambient input signal more than the first ambient input signal if the second ambient input signal includes more of the undesired ambient signal than the first ambient input signal.

8. The device of claim 7:

wherein the ambient input modulation signal attenuates both the first and second ambient input signals if both the first and second ambient input signals include the undesired ambient signal.

9. The device of claim 1:

wherein the undesired ambient signal is wind noise.

10. The device of claim 1:

wherein the undesired ambient signal is vehicular noise.

11. The device of claim 1:

wherein the ambient signal characterization circuit is configured to identify the undesired ambient signal based on the undesired signal's specific frequency content and/or time domain properties.

12. The device of claim 1:

further comprising a set of mixers coupled to receive the first and second ambient output signals;

wherein the set of mixers are coupled to receive a set of audio playback signals from an audio receiver; and wherein the set of mixers are configured to mix the first and second ambient output signals with the set of audio playback signals.

13. The device of claim 12:

wherein the set of mixers include a left audio mixer configured to generate a left mixed audio signal from the first ambient output signal and a left audio playback signal received from an audio receiver; and wherein the set of mixers include a right audio mixer configured to generate a right mixed audio signal from the second ambient output signal and a right audio playback signal from the audio receiver.

14. The device of claim 12:

further comprising a set of acoustic speakers coupled to receive and output the left and right mixed audio signals.

15. The device of claim 1:

further comprising the first and second acoustic transducers.

16. An acoustic circuit, comprising:

a first input configured to receive a first ambient input signal from a first acoustic transducer;

a second input configured to receive a second ambient input signal from a second acoustic transducer;

a first output configured to transmit a first ambient output signal;

a second output configured to transmit a second ambient output signal;

an ambient signal characterization circuit configured to identify an undesired ambient signal within the first and/or second ambient input signals; and an ambient signal control circuit configured to control how the acoustic device controller generates the first and second ambient output signals from the first and second ambient input signals based on the undesired ambient signal;

wherein the first input, a first portion of the acoustic circuit, and the first acoustic transducer are embedded in a first acoustic device;

wherein the second input, a second portion of the acoustic circuit, and the second acoustic transducer are embedded in a second acoustic device;

wherein the first portion of the acoustic circuit is configured to receive the second ambient input signal over a wireless link from the second acoustic device;

wherein the second portion of the acoustic circuit is configured to receive the first ambient input signal over the wireless link from the first acoustic device; and wherein in response to an ambient input selection signal, either the first ambient input signal or the second ambient input signal becomes the second ambient output signal.

17. The device of claim 16:

wherein the first acoustic device is a first earbud and the second acoustic device is a second earbud.

18. The device of claim 16:

wherein the wireless link is a near-field communications link.

19. The device of claim 16:

wherein a first portion of the ambient signal characterization circuit is embedded in the first acoustic device;

wherein a second portion of the ambient signal characterization circuit is embedded in the second acoustic device; and wherein the first portion of the ambient signal characterization circuit and the second portion of the ambient signal characterization circuit communicate over the wireless link and together are configured to identify the undesired ambient signal within the first and/or second ambient input signals.

20. The device of claim 16:

wherein a first portion of the ambient signal control circuit is embedded in the first acoustic device;

wherein a second portion of the ambient signal control circuit is embedded in the second wireless device; and wherein the first portion of the ambient signal control circuit and the second portion of the ambient signal control circuit communicate over the wireless link and together configure how the acoustic device and the second acoustic device generate the first and second ambient output signals from the first and second ambient input signals based on the undesired ambient signal.

21. The device of claim 16:

wherein the first acoustic device includes a left audio mixer coupled to receive the first ambient output signal; and wherein the second acoustic device includes a right audio mixer coupled to receive the second ambient output signal.

22. The device of claim 21:

wherein the left audio mixer is configured to generate a left mixed audio signal from the first ambient output signal and a left audio playback signal received from an audio receiver; and wherein the right audio mixer is configured to generate a right mixed audio signal from the second ambient output signal and a right audio playback signal received over the wireless link from the audio receiver.

23. An acoustic device, comprising:

a first input configured to receive a first ambient input signal from a first acoustic transducer;

a second input configured to receive a second ambient input signal from a second acoustic transducer;

a first output configured to transmit a first ambient output signal;

a second output configured to transmit a second ambient output signal;

an ambient signal characterization circuit configured to identify an undesired ambient signal within the first and/or second ambient input signals; and an ambient signal control circuit configured to control how the acoustic device generates the first and second ambient output signals from the first and second ambient input signals based on the undesired ambient signal;

wherein the ambient signal control circuit outputs an ambient input selection signal;

wherein the ambient input selection signal is set to a first state when the first ambient input signal includes more of the undesired ambient signal than the second ambient input signal; and wherein the first state configures the acoustic device to generate the first and second ambient output signals from only the second ambient input signal.

* * * * *